US009816310B2

(12) United States Patent
Haynes

(10) Patent No.: US 9,816,310 B2
(45) Date of Patent: Nov. 14, 2017

(54) THERMAL BREAK SYSTEM AND METHOD FOR DOORS AND WINDOWS

(71) Applicant: Robin Haynes, Durham, NC (US)

(72) Inventor: Robin Haynes, Durham, NC (US)

(73) Assignee: Donatello Doors Inc., Las Vegas, NV (US)

( * ) Notice: Subject to any disclaimer, the term of this patent is extended or adjusted under 35 U.S.C. 154(b) by 57 days.

(21) Appl. No.: 15/297,113

(22) Filed: Oct. 18, 2016

(65) Prior Publication Data

US 2017/0037672 A1 Feb. 9, 2017

Related U.S. Application Data

(63) Continuation-in-part of application No. 14/833,138, filed on Aug. 23, 2015, now Pat. No. 9,470,037.

(30) Foreign Application Priority Data

Jun. 23, 2016 (CN) ..... 2016 2 0628542 U

(51) Int. Cl.

| | |
|---|---|
| ***E06B 1/22*** | (2006.01) |
| ***E06B 1/52*** | (2006.01) |
| ***E06B 1/70*** | (2006.01) |
| ***E06B 7/14*** | (2006.01) |
| ***E06B 7/23*** | (2006.01) |

(Continued)

(52) U.S. Cl.

CPC ..... *E06B 1/22* (2013.01); *E05B 17/0075* (2013.01); *E06B 1/32* (2013.01); *E06B 1/52* (2013.01); *E06B 1/70* (2013.01); *E06B 7/14* (2013.01); *E06B 7/22* (2013.01); *E06B 7/2312* (2013.01); *E06B 2001/707* (2013.01)

(58) Field of Classification Search

CPC ... E06B 1/18; E06B 1/12; E06B 1/325; E06B 2003/7076; E06B 3/26301; E06B 3/9616; E04B 1/08; E04B 2/7412; E04C 2003/0413; E04C 2003/043; E04C 2003/0465; E04C 3/07; E04C 3/29

See application file for complete search history.

(56) References Cited

U.S. PATENT DOCUMENTS 2,814,603 A 11/1957 Gosselin
3,055,468 A * 9/1962 Horejs ..... E06B 3/26336 49/458

(Continued)

*Primary Examiner* — Joshua J Michener
*Assistant Examiner* — Matthew Gitlin
(74) *Attorney, Agent, or Firm* — Christopher Pilling

(57) ABSTRACT

A door assembly providing a door frame including an inside steel panel having an inner surface and an outer surface, and a C-shaped section extending about a periphery thereof with a portion of the C-shaped section extending in part parallel to the inner surface of the inside steel panel; an outside steel panel having an inner surface and an outer surface, and a C-shaped section extending about a periphery thereof with a portion of the C-shaped section extending in part parallel to the inner surface of the outside steel panel; an insulating material interposed between respective C-shaped sections of the inside steel panel and the outside steel panel to thermally isolate the inside steel panel and the outside steel panel from each other, and said inside steel panel and outside steel panel being secured together at respective C-shaped sections to form the thermal break system.

9 Claims, 6 Drawing Sheets

(51) Int. Cl.

| | |
|---|---|
| ***E06B 1/32*** | (2006.01) |
| ***E06B 7/22*** | (2006.01) |
| ***E05B 17/00*** | (2006.01) |

(56) References Cited

U.S. PATENT DOCUMENTS

| | | | | |
|---|---|---|---|---|
| 3,436,885 | A * | 4/1969 | Rothermel | E04B 2/62 52/207 |
| 3,837,134 | A * | 9/1974 | DiFazio | E06B 3/825 52/784.13 |
| 3,908,313 | A * | 9/1975 | Bierlich | E06B 3/26301 49/501 |
| 3,968,604 | A * | 7/1976 | Hills | E04B 1/3205 52/745.07 |
| 4,107,893 | A * | 8/1978 | Rensch | E04B 1/24 52/775 |
| 4,151,682 | A | 5/1979 | Schmidt | |
| 4,183,393 | A | 1/1980 | Bailey | |
| 4,524,112 | A * | 6/1985 | Willert | E06B 3/273 428/595 |
| 4,594,831 | A | 6/1986 | Winyard | |
| 4,897,971 | A * | 2/1990 | Durston | E04C 2/36 428/116 |
| 4,930,257 | A | 6/1990 | Windgassen | |
| 5,228,257 | A | 7/1993 | Bowersox | |
| 6,430,888 | B1 * | 8/2002 | Dombchik | E04C 3/06 52/653.1 |
| 6,568,149 | B2 | 5/2003 | Lacasse | |
| 6,962,025 | B1 | 11/2005 | Hill | |
| 7,562,497 | B2 * | 7/2009 | Warren | E06B 1/006 52/211 |
| 8,186,132 | B2 | 5/2012 | Howery, Jr. | |
| 8,516,756 | B2 | 9/2013 | Thielmann | |
| 8,615,942 | B2 * | 12/2013 | Lafreniere | E04B 2/766 52/204.2 |
| 8,826,616 | B1 | 9/2014 | Gosselin | |
| 9,068,344 | B2 * | 6/2015 | McKenna | E04B 1/78 |
| 2010/0088977 | A1 | 4/2010 | Darling | |
| 2010/0269450 | A1 | 10/2010 | Thielmann | |
| 2011/0283625 | A1 | 11/2011 | Lenox et al. | |
| 2012/0011793 | A1 | 1/2012 | Clark et al. | |
| 2012/0227338 | A1 * | 9/2012 | Fitzpatrick | E06B 1/08 52/211 |

* cited by examiner

THERMAL BREAK SYSTEM AND METHOD FOR DOORS AND WINDOWS

CROSS-REFERENCE TO RELATED APPLICATION

The present application is a Continuation-In-Part patent application which claims priority to U.S. Utility patent application Ser. No. 14/833,138, filed on Aug. 23, 2015, entitled "Thermal break system and method for door and windows", now U.S. Pat. No. 9,470,037 to issue Oct. 18, 2016, which claims priority to U.S. Provisional Patent Application Ser. No. 61/926,412, filed on Jan. 13, 2014, further this application claim priority to Chinese Patent Application serial number 201620628542.8, filed Jun. 23, 2016 the disclosures of which is hereby incorporated in its entirety at least by reference.

FIELD OF THE INVENTION

The present invention relates to the technical field of building materials, more particularly a thermal break system and method for doors and windows.

BACKGROUND OF THE INVENTION

Aluminum and other metals are often used for the structure of many doors and windows due to their strength and ductability, which facilitates the fabrication of strong windows and doors in a variety of shapes. However, the high conductivity of metal results in low thermal efficiency. Heat is conducted through the door or window structure, into the building on hot days and out of the building on cold days. Extra energy is required to offset this heat transfer and maintain a comfortable environment within the building. Also, on cold days, condensation or even frost can build up on the door or window structure, inside the building, potentially damaging floors and surrounding areas. Consequently, there is a need for a thermal break system that can limit heat transfer and provide energy-saving benefits.

BRIEF SUMMARY

A door assembly is provided, comprising a door frame including an inside steel panel having an inner surface and an outer surface, and a C-shaped section extending about a periphery thereof with a portion of the C-shaped section extending in part parallel to the inner surface of the inside steel panel; an outside steel panel having an inner surface and an outer surface, and a C-shaped section extending about a periphery thereof with a portion of the C-shaped section extending in part parallel to the inner surface of the outside steel panel; an insulating material interposed between respective C-shaped sections of the inside steel panel and the outside steel panel to thermally isolate the inside steel panel and the outside steel panel from each other, and said inside steel panel and outside steel panel being secured together at respective C-shaped sections to form the thermal break system; and a doorjamb including a threshold comprising a second insulating material positioned between a first threshold portion and second threshold portion, wherein the first threshold portion is sloped and includes one or more internal weep tubes passing through the second insulating material and first threshold portion allowing residual rainwater to discharge from the assembly.

In one embodiment, a lockset including lock plates and latch plates, wherein the lockset is offset and positioned entirely in either one of the respective C-shaped section preventing heat transfer though the lock plates and the latch plates.

In another aspect of the invention, a door assembly is provided, comprising a door frame including a first side having a first inner surface, a first outer surface, a first edge, and a second edge, the distance between the first edge and second edge defining a first width; a first panel located at the first edge extending perpendicularly from the first inner surface at a first depth; a second panel located at the second edge extending perpendicularly from the first inner surface at a second depth; a first land perpendicularly connected to the first panel extending parallel to the first inner surface, the first land having a first length; a second land perpendicularly connected to the second panel extending parallel to the first inner surface, the second land having a second length; a second side having a second inner surface, a second outer surface, a third edge, and a fourth edge, the distance between the third edge and fourth edge defining a second width; a third panel located at the third edge extending perpendicularly from the second inner surface at a third depth; a fourth panel located at the fourth edge extending perpendicularly from the second inner surface at a fourth depth; a third land perpendicularly connected to the third panel extending parallel to the second inner surface, the third land having a third length; a fourth land perpendicularly connected to the fourth panel extending parallel to the second inner surface, the fourth land having a fourth length; a first thermal break having a third width positioned between the first and third land; a second thermal break having a fourth width positioned between the second and fourth land; the first width and the second width being identical; the first length, third length, and third width being identical; the second length, the fourth length, and the fourth width being identical; the first depth and the second depth being identical; the third depth and the fourth depth being identical; wherein the outer surface of the first side is exposed to an external environment and the second outer surface of the second side is exposed to an internal environment; and the third and fourth depths are greater than the first and second depths corresponding to the first and second thermal breaks positioned closer to the external environment improving efficiency.

In one embodiment, a plurality of metal screws provided, wherein the plurality of metal screws are designed to clamp the first land, the third land, and the first thermal break together and the second land, the fourth land, and the second thermal break together, the plurality of metal screws providing mechanical strength. In another embodiment, a doorjamb is provided, including a threshold having a third thermal break positioned between a first threshold portion, a second threshold portion, and the doorjamb, wherein the first threshold portion is sloped and includes one or more internal weep tubes passing through the third thermal break and first threshold portion, wherein the one or more internal weep tubes have openings and exits allowing residual rainwater to discharge from the assembly. In one embodiment, the second threshold portion is sloped to allow infiltrated water to flow toward the one or more internal weep tube openings.

In one embodiment, a pair of bottom sweeps are provided, wherein the pair of bottom sweeps are mounted below a door to prevent air in the external environmental from entering the internal environment while providing a heat insulation effect. In another embodiment, a seal is provided, wherein the seal is positioned toward a front end of the first threshold portion providing insulation while blocking air and water infiltration. In one embodiment, a vertical lip is welded to a bottom portion of the door that connects with the seal creating a positive seal against air and water infiltration. In yet another embodiment, a lockset including lock plates and latch plates is provided, wherein the lockset is offset and positioned entirely in either the first side or second side preventing heat transfer though the lock plates and the latch plates.

BRIEF DESCRIPTION OF THE DRAWINGS

Other features and advantages of the present invention will become apparent when the following detailed description is read in conjunction with the accompanying drawings, in which.

DESCRIPTION OF PREFERRED EMBODIMENT

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide a thermal break system and method for doors and windows.

Figure 1:
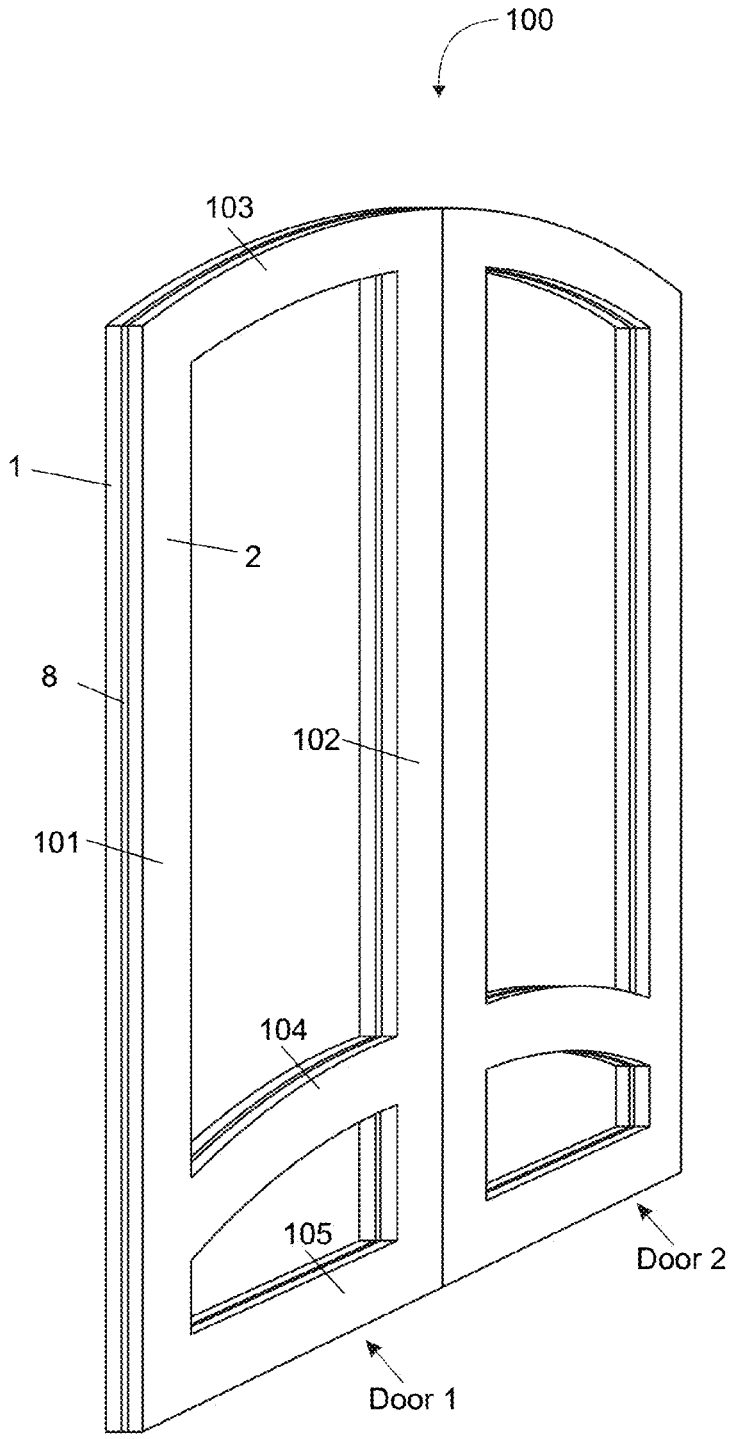
FIG. 1 is a perspective view of a pair of doors constructed according to the present invention.

Referring now to FIGS. 1-8, a thermal break system and method for doors and windows is provided. FIG. 1 illustrates a double-insulated door 100, wherein a threshold (FIG. 6) is located below the double-insulated open doors. The double-insulated doors includes Door 1 and Door 2 each comprising a first vertical rail 101, a second vertical rail 102, a horizontal door panel 105, a curved rail 103, and a curved reinforcing plate 104. The horizontal door panel connects the first and second vertical rails at the bottom of each of the double-insulated open doors, while the curved reinforcing plate is mounted a low portion on the first and second vertical rails as illustrated. Likewise, the curved rail connects the first and second vertical rails at the top of each of the double-insulated open door. Thermal break 8 is affixed between door profiles sides 1 and 2, creating a metal tube. The connection and assembly of these profiles will be described in detail below.

Figure 2:
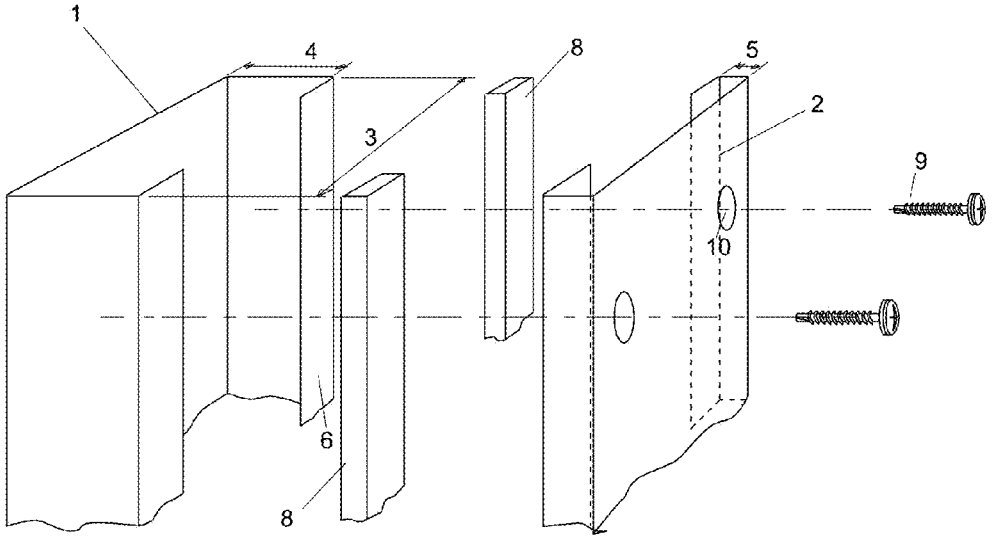
FIG. 2 is an exploded cross section view of a thermal break created in a straight tube assembly.
Figure 3:
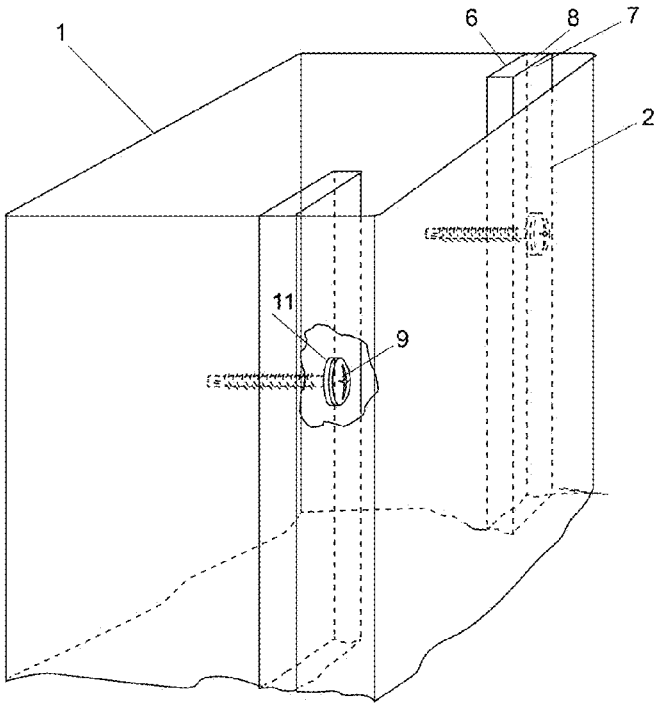
FIG. 3 is a cross-section view of a tube after construction shown with two sides connected through an insulating strip.

Referring now to FIGS. 2 and 3, a tube is constructed using two sides, 1 and 2, made in a "C" profile having identical widths 3 with varying depths 4 and 5. One tube 1 is made up of an outer surface and an inner surface of an outside steel panel, for example, making up the surface of a door facing the exterior. The outer surface thereof faces the exterior of a building. The inner surface faces the tube 2 making up the panel facing the interior of a building. With respect to tube 2, its inner surface faces the inner surface of tube 1, and its outer surface faces the interior of a building when assembled. The sides terminate with lands 6 and 7 having a width which is less than 50% of the width of profiles 1 and 2, determined by the strength requirement of the particular application. Insulating strips 8, with a width approximately the same as lands 6 and a depth sufficient to provide the degree of insulation required, are sandwiched between profiles 1 and 2, coincident with lands 6 and 7. The assembly is joined using a plurality of self-drilling, self-tapping screws 9 in combination with an adhesive means applied to adjacent faces of lands 6 and 7, and insulating strips 8. Screws 9, having an insulating washer means 11 under the screw head, pass through temporary access holes 10, whose diameter is sufficient to allow washer means 11 to easily pass. Typical adhesives useful for the invention include Liquid Nails, Bostick, Dap or Tightbond. Alternative screw arrangements may be self-tapping but not self-drilling, in which case suitable pilot holes may be pre-drilled in lands 6 and 7, as well as insulating strips 8 along an axis coincident with access holes 10.

It is a particular advantage of the present invention that the insulating strips 8 are positioned toward the outside, that is the thermal break is positioned closer to the exterior, wherein depth 4 is larger than depth 5. This configuration reduces the mass on the outside panel or side 2. Further since the weight of the door is carried by the side 1, it lowers stress on door joints and reduces exposure of the outside panel to elements which improves efficiency.

FIG. 3 is a cross-section view of a tube after construction shown with two sides connected through an insulating strip. FIG. 3 shows a cross section of the tube after construction where the sides 1 and 2 are connected with insulating strips 8, typically made of ABS, sandwiched between them. The adjoining faces of lands are connected using a suitable adhesive medium and/or a mechanical connection using a plurality of screws 9 with insulated washer means 11 to connect lands 6 and 7, passing through insulating strips 8. Access holes 10 are not shown since they have been closed with electric arc welding.

Figure 4:
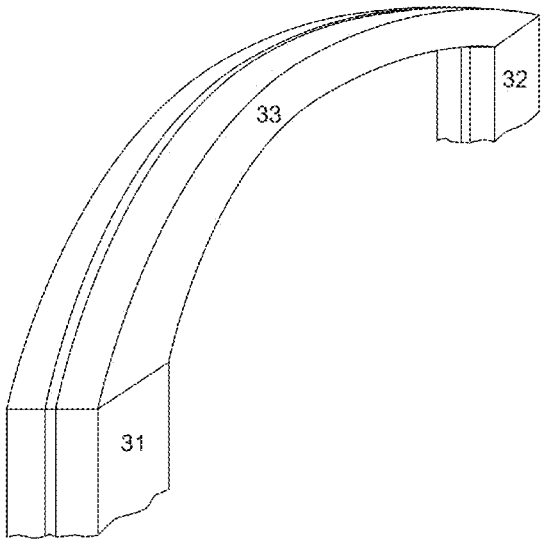
FIG. 4 is a partial top section view of an arched door constructed according to the invention.

FIG. 4 is a partial top section view of an arched door constructed according to the invention. Referring now to FIG. 4 a top section of an arched door frame is shown, which has been constructed using the same method as shown for the embodiment in FIG. 2 and FIG. 3. However, in this case the assembly comprises two upright stiles 31 and 32 and a curved rail 33. The method of construction is essentially similar to that shown in FIG. 2 and FIG. 3.

Figure 5:
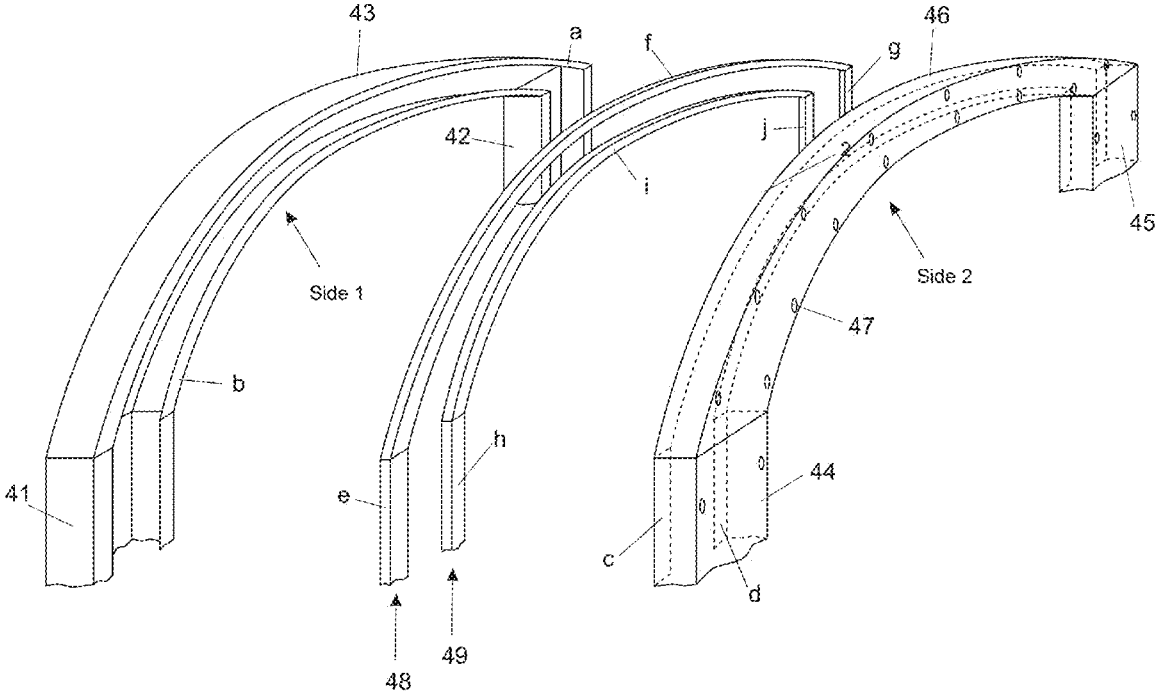
FIG. 5 is an exploded view of the door of FIG. 4 showing the components thereof.

FIG. 5 shows the components of the same section of door shown in FIG. 4 but prior to assembly. Side 1 and side 2 are each comprised of three "C" sections of steel. Side 1 comprises upright stiles 41 and 42, plus a curved rail 43. Side 2 comprises upright stiles 44 and 45, plus a curved rail 46. Upright stiles 42, 42, 44 and 45 have been made by bending sheet steel in a press break. Curved rails 43 and 46 have been fabricated out of sheet steel by cutting the curved shapes that are required in the vertical plane and cutting and bending the shapes needed in the horizontal plain. These components are then welded together to form the curved "C" sections. Specifically, upright stiles 41 and 42 are welded to curved rail 43 to form side 1 of the assembly. Similarly, curved rail 46 and upright stiles 44 and 45 are welded together to form side 2. Side 1 and 2 include lands (a), (b), (c), and (d). Insulating strips 48 and 49 comprising sections (e), (f), (g), (h), (i), and (j) are cut from sheet material to a size and shape coincident with lands (a), (b), (c), and (d) of sides 1 and 2. A plurality of temporary access holes 47 are drilled into side 2 so as to facilitate assembly with adhesive and screws the same as shown in FIGS. 2 and 3. These access holes will be welded closed after assembly.

Figure 6:
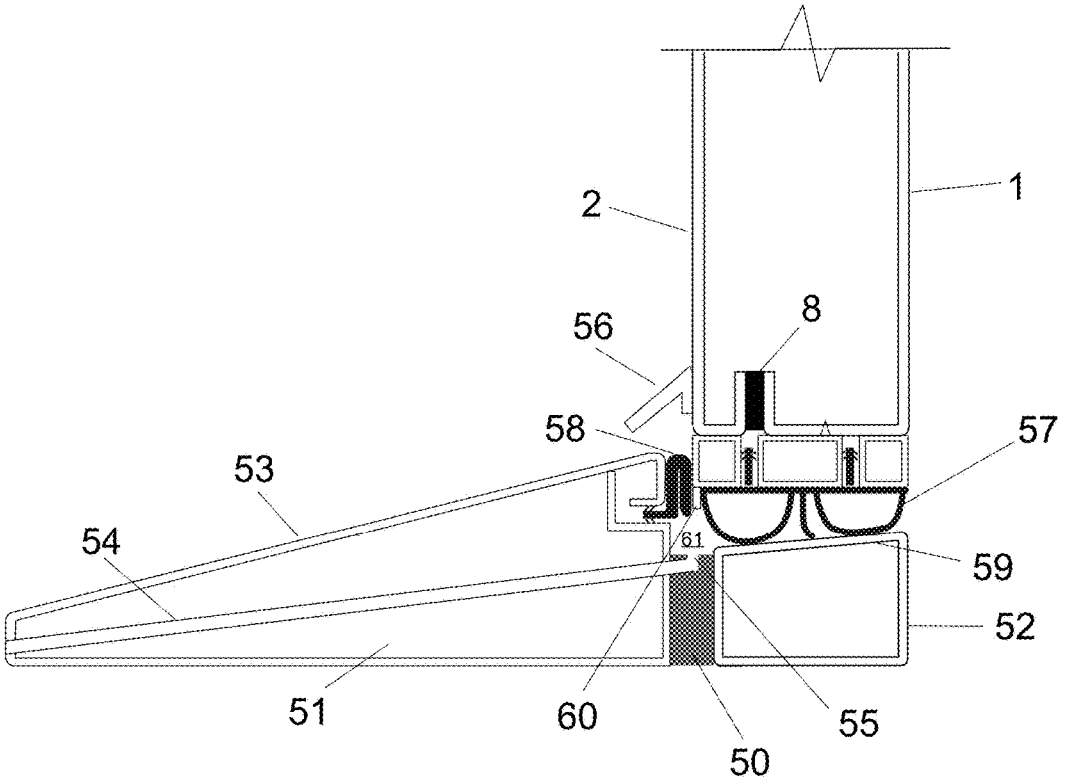
FIG. 6 is a cross-section view of a threshold according to the present invention.

FIG. 6 is a cross-section view of a threshold according to the present invention. Referring now to FIG. 6, insulation 50 (thermal break) is positioned toward the inner end of an outer threshold portion 51, and toward the inside of an inner threshold portion 52 constituting the intermediate heat shield. Preferably, threshold portions 51 and 52 are foam filled. The outside of the front end of the threshold comprises a slope 53, which helps discharge rainwater. Welded to door is a downward slope element 56 or drip guard to direct rainwater to slope 53. Threshold outer portion 51 comprises a weep tube 54 with opening 55, allowing the residual rainwater through the weep to exit beyond the threshold to the outside preventing water and rainfall buildup above the thermal break which would spill into the building. Portion includes sloped surface 59 so that any water infiltrated flows towards weep tube opening 55. Bottom sweeps 57 are mounted below the door, wherein the door sweeps prevents air outside from entering into the building from the outside and provides the heat insulation effect. An embedded kerf seal 58 is included toward the front end of the outer threshold portion 51, wherein the embedded seal provides insulation while blocking air and water infiltration. Although one weep tube is illustrated it is understood that more than one weep tube may be included. Vertical lip 60 welded to door bottom connects with seal 58, creating a positive seal against air and water infiltration. It is a particular advantage of the present invention, that the weep tube passes through thermal break 50 while allowing any accumulated water from space 61 to enter opening 55 of weep tube 54 and exit the threshold.

In one embodiment, the double-insulation door may be comprised of glass. Further, the C-shaped metal tube may be constructed of steel, aluminum, copper or aluminum alloy, or any other conductive material that would require a thermal break in order to control heat transfer. This design approach can be very effective in reducing the energy exchange, energy conservation in cold areas play a positive role. It is a particular advantage of the present invention to protect the doors and windows in cold areas to prevent damage to the doors and windows via frost.

Figure 7:
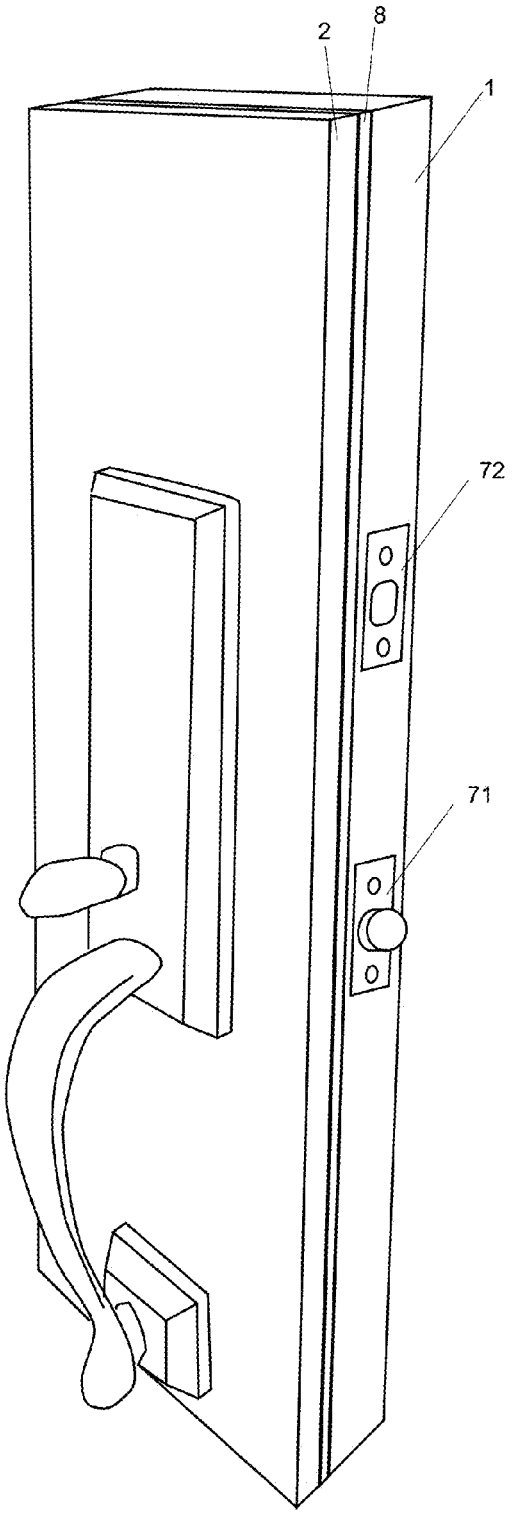
FIG. 7 is partial perspective view of a lockset according to the present invention.

Referring now to FIG. 7, a lockset is illustrated. In another preferred embodiment, C sections 1 and 2 have unequal depths 4 and 5, so that the constructed tube of FIG. 3 is comprised of a larger side and smaller side. The installation of the lockset and/or deadbolt is also offset from center slightly so as to allow the mechanism and edge borings to be contained exclusively within the larger side. This prevents the lock plates 72 and striker plates 71 from creating a thermal bridge by crossing the thermal break, greatly increasing the thermal insulation effect at the position of the lockset, while facilitating the retention of a standard door thickness, between 1¾" and 2¼" thick. It should be understood that although FIG. 7 illustrates side 1 as the larger side, it is understood that side 2 may be the larger side, wherein the wherein the lockset is offset and positioned entirely in the larger side preventing heat transfer though the lock plates and the latch plates.

Figure 8:
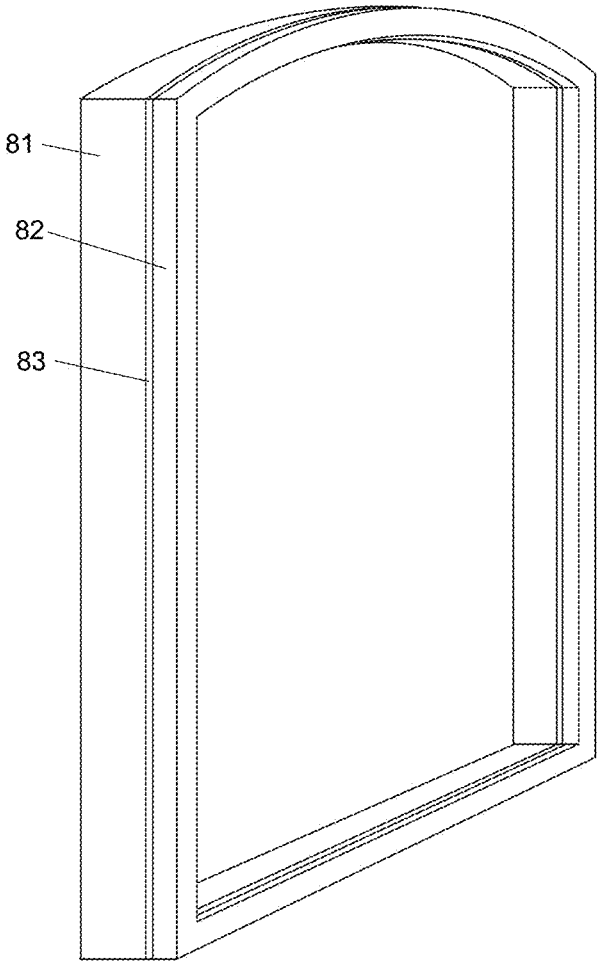
FIG. 8 is a perspective view of a doorjamb according to the present invention.

Referring now to FIG. 8, a doorjamb is illustrated. Similarly to the door frame assembly described above, the doorjamb is comprised of two sides 81 and 82 with an insulation strip or thermal break 83 positioned between the two sides. The doorjamb supports the door frame and threshold as well known in the art.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. A door assembly, comprising:

a door frame including an inside steel panel having a first inner surface and a first outer surface, and a first C-shaped section with a first portion of the first C-shaped section extending parallel to the inner surface of the inside steel panel; an outside steel panel having a second inner surface and a second outer surface, and a second C-shaped section with a second portion of the C-shaped section extending parallel to the second inner surface of the outside steel panel; a first insulating material interposed between the first and second C-shaped sections of the inside steel panel and the outside steel panel to thermally isolate the inside steel panel and the outside steel panel from each other, and said inside steel panel and outside steel panel being secured together at the first and second C-shaped sections to form a thermal break system; and a doorjamb including a threshold comprising a second insulating material positioned between a first threshold portion and second threshold portion, wherein the first threshold portion is sloped to allow water to collect at the first insulating material and includes one or more internal weep tubes passing through the second insulating material and first threshold portion allowing residual rainwater to discharge from the assembly.

2. The door assembly of claim 1, further comprising a lockset including lock plates and latch plates, wherein the lockset is offset and positioned entirely in either one of the first or second C-shaped sections preventing heat transfer though the lock plates and the latch plates.

3. A door assembly comprising: a door frame including a first side having a first inner surface, a first outer surface, a first edge, and a second edge, the distance between the first edge and second edge defining a first width; a first panel located at the first edge extending perpendicularly from the first inner surface at a first depth; a second panel located at the second edge extending perpendicularly from the first inner surface at a second depth; a first land perpendicularly connected to the first panel extending parallel to the first inner surface, the first land having a first length; a second land perpendicularly connected to the second panel extending parallel to the first inner surface, the second land having a second length; a second side having a second inner surface, a second outer surface, a third edge, and a fourth edge, the distance between the third edge and fourth edge defining a second width; a third panel located at the third edge extending perpendicularly from the second inner surface at a third depth; a fourth panel located at the fourth edge extending perpendicularly from the second inner surface at a fourth depth; a third land perpendicularly connected to the third panel extending parallel to the second inner surface, the third land having a third length; a fourth land perpendicularly connected to the fourth panel extending parallel to the second inner surface, the fourth land having a fourth length; a first thermal break having a third width positioned between the first and third land; a second thermal break having a fourth width positioned between the second and fourth land; the first width and the second width being identical; the first length, third length, and third width being identical; the second length, the fourth length, and the fourth width being identical; the first depth and the second depth being identical; the third depth and the fourth depth being identical; wherein the outer surface of the first side is exposed to an external environment and the second outer surface of the second side is exposed to an internal environment; the third and fourth depths are greater than the first and second depths which correspond to the first and second thermal breaks being positioned closer to the external environment improving efficiency; and a pularity of metal screws clamping the first land, the third land, and the first thermal break together and the second land, the fourth land, and the second thermal break together, the plurarity of metal screws providing mechanical strength.

4. The door assembly of claim 3, further comprising a doorjamb including a threshold having a third thermal break positioned between a first threshold portion, a second treshold portion, and the doorjamb, wherein the first threshold portion is sloped and includes one or more internal weep tubes passing through the third thermal break and first threshold portion, wherein the one or more internal weep tubes have openings and exits allowing residual rainwater to discharge from the assembly.

5. The door assembly of claim 4, wherein the second threshold portion is sloped to allow infiltrated water to flow toward the one or more internal weep tube openings.

6. The door assembly of claim 4, further comprising a pair of bottom sweeps mounted below a door to prevent air in the external environmental from entering the internal environment while providing a heat insulation effect.

7. The door assembly of claim 6, further comprising a seal positioned toward a front end of the first threshold portion providing insulation while blocking air and water infiltration.

8. The door assembly of claim 7, further comprising a vertical lip welded to a bottom portion of the door that connects with the seal creating a positive seal against air and water infiltration.

9. The door assembly of claim 3, further comprising a lockset including lock plates and latch plates, wherein the lockset is offset and positioned entirely in either the first side or second side preventing heat transfer though the lock plates and the latch plates.

* * * * *